United States Patent [19]

Gritzner

[11]B 4,035,254

[45] July 12, 1977

[54] OPERATION OF A CATION EXCHANGE MEMBRANE ELECTROLYTIC CELL FOR PRODUCING CHLORINE INCLUDING FEEDING AN OXIDIZING GAS HAVING A REGULATED MOISTURE CONTENT TO THE CATHODE

[75] Inventor: Gerhard Gritzner, Midland, Mich.

[73] Assignee: The Dow Chemical Company, Midland, Mich.

[21] Appl. No.: 361,744

[22] Filed: May 18, 1973

[44] Published under the first Trial Voluntary Protest Program on Jan. 28, 1975 as document No. B 361,744

[51] Int. Cl. .....C25B 1/16, C25B 1/26, C25B 11/03

[52] U.S. Cl. ..... 204/98; 204/128; 204/265; 204/266; 204/277; 204/DIG. 3

[58] Field of Search ..... 204/98, 128, 265, 266, 204/277, DIG. 3

[56] References Cited

U.S. PATENT DOCUMENTS

| | | | |
|---|---|---|---|
| 2,681,884 | 6/1954 | Butler, Jr.; | 204/98 |
| 2,967,807 | 1/1961 | Osborne et al. | 204/98 |
| 3,262,868 | 7/1966 | Juda | 204/98 |
| 3,616,328 | 10/1971 | Currey | 204/98 |

FOREIGN PATENT DOCUMENTS

| | | | |
|---|---|---|---|
| 832,196 | 4/1960 | United Kingdom | 204/98 |
| 542,358 | 1/1942 | United Kingdom | 204/256 |

OTHER PUBLICATIONS

Kirk-Othmer, "Encyclopedia of Chemical Technology," Vol. 3 (1964).

Kirk-Othmer, "Encyclopedia of Chemical Technology," Supplement Volume (1971), pp. 386 and 387.

*Primary Examiner*—John H. Mack
*Assistant Examiner*—Arthur C. Prescott
*Attorney, Agent, or Firm*—Robert W. Selby

[57] ABSTRACT

Improved apparatus and process to electrolytically produce chlorine gas and an alkali metal hydroxide in a diaphragm cell. The improved process comprises employing a cation exchange diaphragm and contacting a foraminous cathode with an oxidizing gas having a regulatably controlled moisture content, while substantially simultaneously regulating the anolyte and catholyte compositions. The catholyte upper surface level is kept at a higher level than the anolyte upper surface.

10 Claims, 2 Drawing Figures

34a
30a
22a
10a
18a
32a
16a
39
20a
14a
28a
12a
22b
36
Power source
38
22
24
30
18
31
P
26
34
12
16
32
14
33
20
36
40
28
10

OPERATION OF A CATION EXCHANGE MEMBRANE ELECTROLYTIC CELL FOR PRODUCING CHLORINE INCLUDING FEEDING AN OXIDIZING GAS HAVING A REGULATED MOISTURE CONTENT TO THE CATHODE

BACKGROUND OF THE INVENTION

This invention pertains to the electrolytic production of chlorine in a diaphragm cell and more in particular to an electrolytic cell containing an oxidizing gas depolarized cathode and a method of producing chlorine and an alkali metal hydroxide in such electrolytic cell.

Gaseous chlorine has long been produced from sodium chloride in an electrolytic cell having an anode positioned within an anode chamber and a cathode in a cathode chamber spaced apart from the anode chamber by an ion and liquid permeable diaphragm, such as one at least partially formed of asbestos. In such an electrolytic cell chlorine is released at the anode and sodium hydroxide is formed in the cathode chamber.

Various methods to conserve electrical power in electrolytic cells have been developed using porous cathodes in combination with an oxidizing gas to depolarize the electrode; see for example, Juda, U.S. 3,124,520. It is desired to provide an improved apparatus and process to reduce the electrical consumption of chlorine producing electrolytic diaphragm cells.

SUMMARY OF THE INVENTION

An improved electrolytic cell to produce chlorine and an alkali metal hydroxide has been developed. The electrolytic cell comprises an anode compartment suited to contain an anolyte such as an aqueous solution or mixture of an alkali metal chloride, for example, sodium chloride. A cathode compartment adapted to contain a catholyte containing the hydroxide of the alkali metal is spaced apart from the anode compartment by a diaphragm. The diaphragm separating the anode and cathode compartments is a cation exchange membrane adapted to pass ions of the alkali metal from the anode compartment to the cathode compartment. The diaphragm is suitably positioned in the electrolytic cell to substantially entirely separate the anode compartment from the cathode compartment.

An anode is suitably positioned within the anode compartment and a cathode is suitably positioned within the cathode compartment to be spaced apart from the diaphragm, that is substantially all of the catholyte is contained within a space or opening at least partially defined by the diaphragm and at least partially by an outer surface of the cathode. The cathode is further adapted to have at least one wall portion in contact with the catholyte and at least one other wall portion substantially simultaneously in contact with an oxidizing gas.

Means to circulate the catholyte at least within the cathode compartment and to control the catholyte composition are in operative combination with the cathode compartment. A means to control the moisture content of the oxidizing gas in contact with the cathode is in operative combination with the cathode.

A means to supply a direct current to the anode and the cathode is suitably electrically connected to these electrodes. The electrolytic cell further includes means to control the anolyte composition, means to remove the chlorine produced from the anode compartment and a means to remove the alkali metal hydroxide formed from the cathode compartment.

The described electrolytic cell is advantageously used in an improved process to produce chlorine and an alkali metal hydroxide. In the improved process sufficient alkali chloride brine is fed into and circulated through the anode compartment to maintain the anolyte at a desired alkali metal chloride concentration. Substantially simultaneously the catholyte is maintained at a desired alkali metal hydroxide concentration. Sufficient electrical energy is supplied to the anode and cathode to release gaseous chlorine at the anode and to form the alkali metal hydroxide in the cathode compartment. The gaseous chlorine and alkali metal hydroxide are suitably recovered by means known to those skilled in the art.

The efficiency of the cell is improved by maintaining the catholyte head at least equal that of the anolyte and substantially simultaneously contacting different wall portions of the cathode with the catholyte and with an oxidizing gas. The moisture content of the oxidizing gas is suitably controlled to minimize drying and deposition of materials such as sodium chloride, sodium hydroxide and the like on the cathode surface. The catholyte is circulated within the cathode compartment to maximize contact between the catholyte and the cathode to thereby further improve the electrical efficiency of the cell.

DESCRIPTION OF THE DRAWING

The accompanying drawing further illustrates the invention.

Identical numbers, distinguished by a letter suffix, within the several figures represent parts having a similar function within the different embodiments.

DESCRIPTION OF THE PREFERRED EMBODIMENTS

Figures 1, 2:
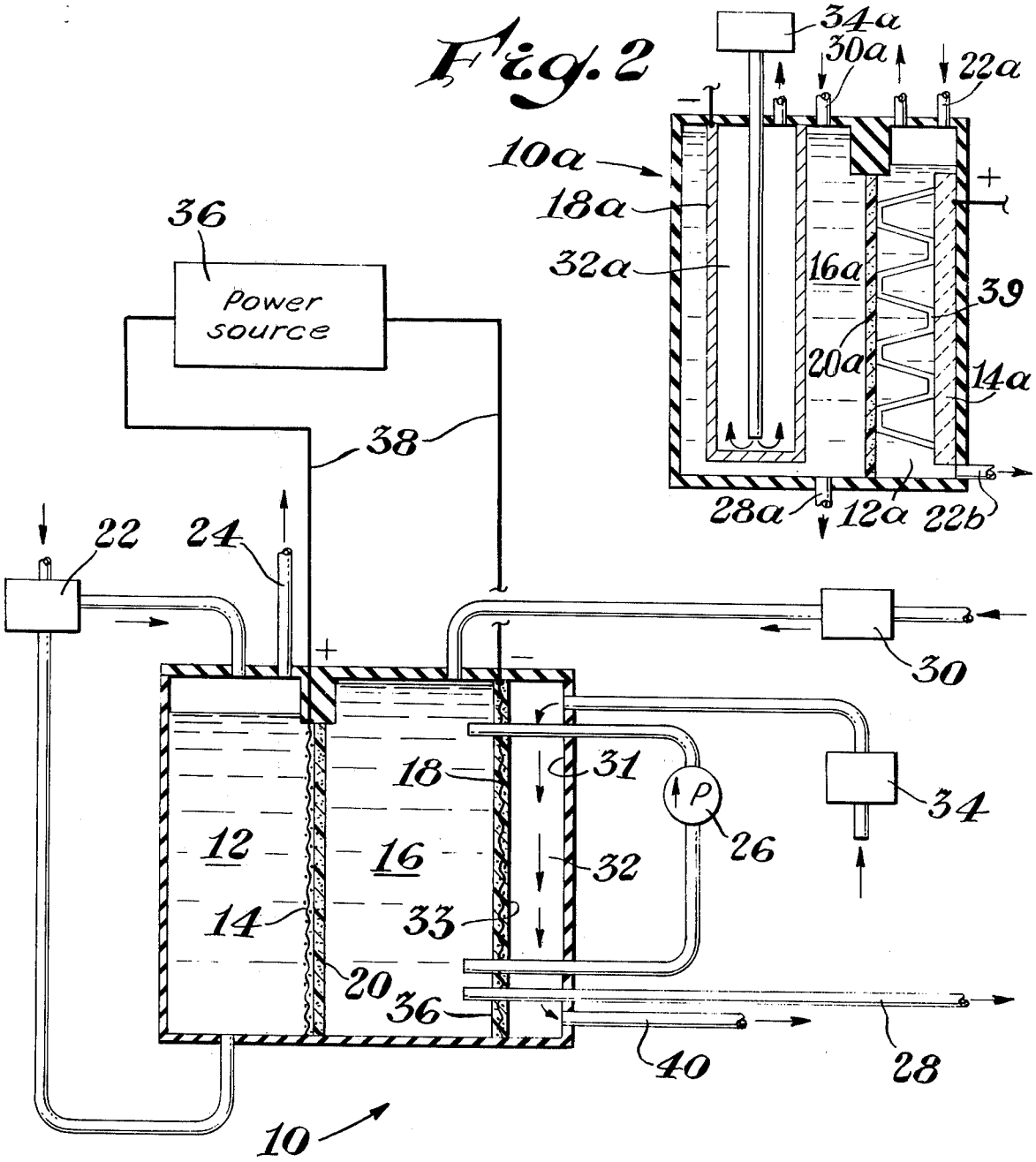
In FIG. 1 is depicted a cross sectional view of one embodiment of the invention.
In FIG. 2 is a cross sectional view of another embodiment of the invention.

An electrolytic cell 10 of FIG. 1 includes an anode compartment 12 with an anode 14 positioned therein juxtaposed and spaced apart from a cathode compartment 16 with a depolarized cathode 18 positioned therein. The anode compartment 12 is spaced apart from the cathode compartment 16 by a cation exchange membrane or diaphragm 20 adapted to pass alkali metal ions from the anode compartment 12 to the cathode compartment 16. The anode 14 optionally acts as a supporting member for the diaphragm 20. Cation exchange membranes are well-known to contain fixed anionic groups that permit intrusion and exchange of cations, and exclude anions, from an external source. Generally the resinous membrane or diaphragm has as a matrix a cross-linked polymer, to which are attached charged radicals such as $-SO_3^-$, $-COO^-$, $-PO_3^=$, $-HPO_2^-$, $-AsO_3^=$ and $-SeO_3^-$. Vinyl addition polymers and condensation polymers may be employed. The polymer can be, for example, styrene, divinylbenzene, polyethylene and fluorocarbons. Condensation polymers are, for example, phenol sulfuric acid and formaldehyde resins. A method of preparing such resinous materials is described in U.S. Pat. No. 3,282,875.

The electrolytic cell 10 further includes a source of alkali metal chloride brine (not shown) and a means 22 to introduce or feed the brine into the anode compartment 12 and maintain the anolyte at a predetermined desired alkali metal chloride concentration. A gaseous chlorine removal means such as a pipe 24 is suitably connected to the anode compartment 12 to afford removal of gaseous chlorine without substantial loss of chlorine to the ambient atmosphere.

A means, such as an ultrasonic vibrator, turbine type impeller or pump 26, to circulate the catholyte at least within the cathode compartment 16 is optionally and preferably in combination with the cathode compartment 16. The pump 26 together with appropriate conduits extending into the cathode chamber 16 are provided to afford effective circulation of the catholyte during operation of the cell 10. Generally the catholyte will be pumped in a manner to enter at the upper portion of the cathode chamber 16 and be withdrawn at the lower portion of the chamber; however, pumping can be carried out to remove catholyte at the upper portion of the cathode chamber.

During operation of the electrolytic cell 10 the catholyte contains increasing concentrations of an alkali metal hydroxide, such as sodium hydroxide, which for efficient operation should be removed from the cathode compartment 16 to reduce the hydroxide concentration. For this purpose an alkali metal hydroxide removal means such as pipe 28 as in combination with the cathode compartment 16. The hydroxide concentration of the catholyte can be regulatably controlled by, for example, adding water to a portion of the catholyte and recirculating it into the cathode compartment 16 through a recirculating means 30. When the flow through the recirculating means is insufficient to minimize stagnant catholyte portions within the cathode compartment 16, the pump 26 can be used to supplement the circulatory effect of the recirculating means 30.

The cathode 18 is spaced apart from a side portion or wall 31 of the cell 10 to form an opening or gas compartment 32 between the cathode 18 and the inner surface of the wall 31. An oxidizing gas, for example air and oxygen, with the moisture content suitably controlled by a moisture control means 34 is pumped into, preferably, the upper portion of the gas compartment 32 and passed in intimate contact with an outer surface 33 of the cathode 18 and withdrawn through removal means 40 for disposal. The cathode 18 is formed of a material adapted to transmit or pass an oxidizing gas from the gas compartment 32 to an inner portion or surface 36 of the cathode 18. Preferably, formation of oxidizing gas bubbles on the inner surface 36 of the cathode 18 is minimized and more preferably the inner surface of the cathode is substantially free of oxidizing gas bubbles. An oxidizing gas moisture control means 34 is provided to regulatably control the dew point of the oxidizing gas introduced into the gas compartment 32 to minimize and preferably substantially entirely eliminate accumulation of liquid water within the gas compartment 32. The moisture control means 34 is further adapted to maintain the oxidizing gas moisture content at a concentration adequate to minimize and preferably entirely prevent removal of sufficient moisture from the catholyte within the cathode compartment 16 to result in deposition of solid materials such as sodium chloride or sodium hydroxide in, for example, the pores of the cathode 18. Preferably the moisture control means 34 is adapted to regulate the moisture content of the oxidizing gas within the range of from about 50 to 100 per cent of saturation.

The cathode 18, which is used in combination with the oxidizing gas control means 34, is preferably a foraminous body, such as a screen, expanded metal or a sheet with holes extending therethrough, having at least the surface thereof composed of a material substantially inert to the catholyte such as, for example, Ru, Rh, Pd, Ag, Os, Ir, Pt, Au and Ni with a coating of a mixture of the particulate inert metal and for example, polytetrafluoroethylene, polyhexafluoropropylene and other polyhalogenated ethylene or propylene derivatives. Preferably the inert material is what is known in the art as platinum black, silver black, carbon black, nickel black or nickel oxide black. Particulate designated as "black" generally and preferably has a U.S. Standard Mesh size range of less than about 300. Preferably the cathode 18 is a screen at least partially woven from or adherently coated with metallic platinum, silver, gold or nickel with a mesh size of about 30 to about 60.

A source of electrical energy 36 is electrically connected to an energy transmission or carrying means such as aluminum or copper conduit as bus bar or cables 38 to transmit direct electrical current to the anode 14 and the cathode 18.

In operation of the electrolytic cell 10 an alkali metal chloride containing brine, such as sodium chloride, is supplied or fed through the brine feed means 22 into the anode chamber 12 wherein, through electrolytic processes known to those skilled in the art, gaseous chlorine is formed and removed through pipe 24 and thence to a chlorine condensing and storage system (not shown). Preferably substantially only sodium ions pass through the cation exchange diaphragm 20 into the cathode compartment 16 wherein sodium hydroxide is formed. An oxidizing gas, preferably oxygen, is fed into the gas compartment 32 within the cathode 18 substantially simultaneously with formation of the sodium hydroxide. The presence of the oxidizing gas and the physical contact thereof with the outer surface 33 of the cathode 18, while the inner surface 36 of the cathode 18 is simultaneously in contact with the sodium hydroxide containing catholyte, is believed to minimize and preferably prevent formation of gaseous hydrogen in the cathode compartment 16 to thereby reduce the electrical consumption and improve the electrical efficiency of the cell. Excess oxidizing gas is removed from the gas compartment 32 through the oxidizing gas removal means or conduit 40.

Operation of the cell is even further improved by regulatably controlling the catholyte head (i.e., the vertical difference, if any, between the upper surfaces of the anolyte and the catholyte) at a higher level than the anolyte surface. Preferably the upper surface of the catholyte is about 1 inch to about 3 feet higher than that of the anolyte.

To minimize what is believed to be formation of hydrogen at the cathode 18 it is desirable that substantially all of the catholyte comes into contact with the cathode. To promote such contact and reduce the occurrence of stagnant portions of catholyte within the cathode compartment 16 where little movement of the catholyte occurs, the catholyte is preferably circulated at a rate sufficient for substantially all of the catholyte to contact the cathode 18 and insufficient to result in physical injury to the cation exchange diaphragm 20.

FIG. 2 is illustrative of an electrolytic cell 10*a* having therein an anode compartment or chamber 12*a* spaced apart from a cathode compartment or chamber 16*a* by a cation exchange diaphragm 20*a*. An anode 14*a* is suitably attached in the anode chamber 12*a*. Likewise, a cathode 18*a* is suitably attached in the cathode compartment 16*a*. The anode is constructed of a material such as carbon or what is known in the art as dimensionally stable anode such as titanium or tantalum coated or plated with materials including, for example, at least one metal or oxide of the platinum group metals including Ru, Rh, Pd, Ag, Os, Ir, Pt and Au.

The cathode 18*a* is preferably a silver plated foraminous copper substrate such as a copper screen or sheet with a thickness of about 0.01 to about 0.02 inch and sufficient pores or holes with a diameter of about 0.015 to about 0.03 inch extending therethrough to provide a total hole or open area equivalent to about 20 to about 40 per cent of that portion of the copper sheet having the greatest surface area. The foraminous copper sheet is preferably coated or plated with sufficient metallic silver to provide a substantially continuous silver layer with a thickness of up to about 0.002 inch. Plating of the copper substrate is carried out in a manner known to those skilled in the plating art. A screen woven from about 0.005 to about 0.02 inch diameter wire into a screen having a U.S. Standard Mesh size of about 20 to about 50 is satisfactory when plated with silver as described above. More preferably the cathode is nickel or a nickel base alloy resistant to the corrosive effects of the catholyte. The metal substrate is coated with a mixture of platinum black, silver black or carbon black and, for example, polytetrafluoroethylene or a fluorinated copolymer of hexafluoropropylene or tetrafluoroethylene. The mixture preferably contains from about 30 to about 70 weight per cent carbon black with a mesh size of less than about 300 admixed with up to about 10 weight per cent carbon fibers. The balance of the mixture is essentially the organic material and impurities generally found in the carbon and the organic material. The organic mixture coated, silver plated copper is preferably substantially impervious to passage of the catholyte. The term copper includes commercially pure copper and copper base alloys.

A diaphragm support such as member 39 is adapted to retain the resinous diaphragm in an upstanding position and still permit effective flow of catholyte through the cathode chamber 12*a*.

The alkali metal hydroxide, such as sodium hydroxide, concentration of the catholyte is controlled at a predetermined desired level by appropriate means (not shown) attached to pipes 28*a* and 30*a*. The alkali metal chloride, such as sodium chloride, concentration is controlled at a predetermined desired level by appropriate means (not shown) attached to pipes 22*a* and 22*b*. Such anolyte and catholyte control means can include, for example, recirculatory systems to add water, sodium chloride, or remove sodium hydroxide.

An oxidizing gas is pumped through a moisture control means 34*a* into a gas compartment 32*a* at least partially defined by wall portions of the cathode 18*a*.

Operation of the electrolytic cell 10*a* is substantially the same as that described for the embodiment of FIG. 1 except that the catholyte is circulated within the cathode chamber by pumping through the recirculating and analysis control means (not shown) attached to the pipes 28*a* and 30*a* at a rate effective to minimize stagnant portions of catholyte.

The following examples further illustrate the invention.

EXAMPLE 1

An electrolytic cell similar to that shown in FIG. 1 with a ruthenium oxide coated titanium anode spaced apart from an oxygen gas depolarized cathode by a du Pont Nafion 12V6Cl cation exchange membrane was operated to produce chlorine gas at the anode and sodium hydroxide in the cathode compartment. Each electrode had a surface area of 3 square inches. The cathode was formed by admixing 7 grams of carbon black with 0.2 grams of carbon fiber, 3.3 milliliters of du Pont Teflon 30B latex and about 20 to 30 milliliters of water to form a dough-like mixture. The mixture was rolled to about 0.05 inches thick and then pressed together with a 40 mesh woven silver screen using a force of about 15 tons. The pressed composite was heated in a nitrogen atmosphere for about 2 to 3 minutes at a temperature of about 350° to 360°C. After cooling in a nitrogen atmosphere the composite was heated to about 100° to 120°C and sprayed on a single surface with sufficient Teflon 30B latex (diluted one part latex to eight parts water) to form a coating of about 2 to 10 milligrams Teflon per square centimeter of surface. The sprayed composite was then heated for about 2 minutes at about 350° to 360°C in a nitrogen atmosphere. The sprayed Teflon surface was positioned in the cell to form a wall portion of a depolarizing gas compartment.

An aqueous sodium chloride brine was circulated through the anode compartment, with sodium chloride additions for composition control, and a sodium hydroxide containing catholyte was circulated, with water additions for composition control. Oxygen gas was pumped through the gas compartment at a rate of 66 milliliters per minute after first saturating the oxygen with water. During operation the anolyte had an acidity (pH) of 5.5 and contained about 260 to 290 grams per liter sodium chloride. The catholyte contained 79.6 grams per liter sodium hydroxide and 4.1 grams per liter sodium chloride. The electrolyte temperature was about 70°C. The catholyte head was 1½ inches higher than the anolyte. Operating voltage was 1.901 and the amperage was 1.5. Cell operation was satisfactory without production of hydrogen gas in the cathode compartment.

EXAMPLE 2

A cell substantially as described in Example 1 was operated as described in Example 1 with 66 milliliters per minute of water saturated oxygen depolarizing gas. The aqueous anolyte had a pH of 6.25 and about 260 to 290 grams per liter sodium chloride. The aqueous catholyte contained 102.4 grams per liter sodium hydroxide. Catholyte head was one-fourth inch higher than the anolyte. Cell voltage was 1.888 and the amperage was 1.5.

EXAMPLES 3–30

An electrolytic cell substantially as described in Example 1 was operated with a woven nickel screen cathode. The cathode was prepared substantially as described in Example 1. The anolyte was maintained at a concentration of about 260 to 290 grams per liter NaCl and the catholyte maintained at about 80 to 100 grams per liter NaOH. A water saturated oxygen depolarizing gas was pumped through the gas compartment adjacent to the cathode at a rate of 43 milliliters per minute. Cell operation was satisfactory without hydrogen production in the cathode compartment. Operating currents and voltages are shown in Table I.

TABLE I

| Example | Temp.(°C) | Voltage(volts) | Current(Amp.) |
|---|---|---|---|
| 3 | 25 | 1.600 | 0.5 |
| 4 | 70 | 1.820 | 1.2 |
| 5 | 25 | 1.647 | 0.5 |
| 6 | 25 | 1.815 | 0.5 |
| 7 | 70 | 2.032 | 1.0 |
| 8 | 70 | 2.230 | 1.5 |
| 9 | do. | 1.502 | 0.2 |
| 10 | do. | 1.655 | 0.4 |
| 11 | do. | 1.799 | 0.6 |
| 12 | do. | 1.945 | 0.8 |
| 13 | do. | 2.085 | 1.0 |
| 14 | do. | 2.218 | 1.2 |
| 15 | do. | 2.349 | 1.4 |
| 16 | do. | 2.485 | 1.6 |
| 17 | do. | 2.610 | 1.8 |
| 18 | do. | 2.737 | 2.0 |
| 19 | do. | 2.863 | 2.2 |
| 20 | do. | 2.981 | 2.4 |
| 21 | do. | 3.090 | 2.6 |
| 22 | do. | 3.196 | 2.8 |
| 23 | do. | 3.210 | 3.0 |
| 24 | do. | 3.290 | 3.2 |
| 25 | do. | 3.384 | 3.4 |
| 26 | do. | 3.477 | 3.6 |
| 27 | do. | 3.572 | 3.8 |
| 28 | do. | 3.660 | 4.0 |
| 29 | do. | 3.740 | 4.2 |
| 30 | do. | 3.825 | 4.4 |

What is claimed is:

1. In a process to produce chlorine and an alkali metal hydroxide in an electrolytic diaphragm cell by feeding an alkali chloride brine to an anode compartment and passing alkali metal ions through the diaphragm into a cathode chamber, supplying sufficient electrical energy to an anode positioned in the anode compartment and a cathode positioned in the cathode compartment to release gaseous chlorine at the anode and form an alkali metal hydroxide in the cathode compartment and recovering the chlorine and alkali metal hydroxide, the improvement in the cell with a cation exchange diaphragm comprising substantially simultaneously contacting different surface portions of the cathode with the catholyte and with an oxidizing gas, regulatably controlling the moisture content of the oxidizing gas, entering the cell so as to minimize deposition of solid materials on the cathode circulating the catholyte within the cathode compartment and controlling the catholyte head to maintain the catholyte upper surface level at a higher level than the anolyte upper surface level to thereby improve the electrical efficiency of the cell.

2. The improvement of claim 1 including controlling the catholyte upper surface within the range of from about 1 inch to about 3 feet higher than the upper surface of the anolyte.

3. The improvement of claim 1 including feeding the oxidizing gas at a rate sufficient to minimize release of hydrogen into the catholyte.

4. The improvement of claim 1 including controlling the moisture content of the oxidizing gas within the range of from about 50 to about 100 per cent of saturation.

5. The improvement of claim 1 wherein the oxidizing gas is oxygen.

6. The improvement of claim 1 wherein the oxidizing gas is air.

7. The improvement of claim 1 wherein the alkali metal is sodium.

8. The improvement of claim 1 including controlling the oxidizing gas to minimize formation of oxidizing gas bubbles on the outer surface of the cathode.

9. The improvement of claim 1 wherein the moisture content of the oxidizing gas is controlled to minimize accumulation of liquid water within an oxidizing gas compartment in the cell.

10. The improvement of claim 4 wherein the moisture content of the oxidizing gas is controlled to minimize accumulation of liquid water within an oxidizing gas compartment in the cell.

* * * * *